US006412296B1

(12) United States Patent
Rossi

(10) Patent No.: US 6,412,296 B1
(45) Date of Patent: Jul. 2, 2002

(54) DEVICE TO DISTRIBUTE AIR IN GLASS-FRONTED CABINETS AND DISPLAY COUNTERS

(75) Inventor: Bruna Rossi, Bastia Umbra (IT)

(73) Assignee: ISA SpA, Bastia Umbra (IT)

( * ) Notice: Subject to any disclaimer, the term of this patent is extended or adjusted under 35 U.S.C. 154(b) by 0 days.

(21) Appl. No.: 09/504,124

(22) Filed: Feb. 15, 2000

Related U.S. Application Data

(60) Provisional application No. 60/132,145, filed on May 3, 1999.

(30) Foreign Application Priority Data

Feb. 19, 1999 (IT) ..... UD99A0036

(51) Int. Cl.[7] ..... A47F 3/04
(52) U.S. Cl. ..... 62/255
(58) Field of Search ..... 62/248, 255, 256, 62/407; 454/193

(56) References Cited

U.S. PATENT DOCUMENTS

| | | | | |
|---|---|---|---|---|
| 2,241,854 A | * | 5/1941 | Hall et al. | 62/256 |
| 2,706,387 A | | 4/1955 | Swanson | |
| 3,465,536 A | * | 9/1969 | Vogel et al. | 62/255 |
| 4,603,557 A | * | 8/1986 | Halbmann | 62/255 |
| 4,750,335 A | * | 6/1988 | Wallace et al. | 62/248 |
| 4,949,554 A | * | 8/1990 | Branz et al. | 62/248 |
| 5,046,328 A | * | 9/1991 | Yoshida et al. | 62/255 |
| 5,606,863 A | | 3/1997 | Kicklighter | |
| 5,675,983 A | | 10/1997 | Ibrahim | |

FOREIGN PATENT DOCUMENTS

| | | |
|---|---|---|
| CH | 643444 | 6/1984 |
| DE | 3137961 | 4/1983 |
| DE | 3704245 | 8/1988 |
| GB | 889038 | 2/1962 |

* cited by examiner

*Primary Examiner*—William E. Tapolcai
*Assistant Examiner*—Mohammad M Ali
(74) *Attorney, Agent, or Firm*—Antonelli, Terry, Stout & Kraus, LLP

(57) ABSTRACT

Device to distribute air for glass-fronted cabinets, counters, or in general containers which are refrigerated, heated or otherwise climatically conditioned, said containers (10) comprising a compartment (15) defining a volume containing the foodstuffs to be conserved, and possibly one or more overlying levels to contain the products facing the customer's side, said containers (10) also comprising a technical compartment (16) inside which the ventilation unit (22) and the thermal conditioning unit (30) are housed, said containers (10) comprising at least a transparent front element (20) facing the customer's side, the device comprising a conveyor element (25) transparent and substantially invisible arranged inside the compartment (15) and able to define, together with said transparent front element (20), an air-conveyor channel (26) which affects at least part of said transparent front element (20).

21 Claims, 1 Drawing Sheet

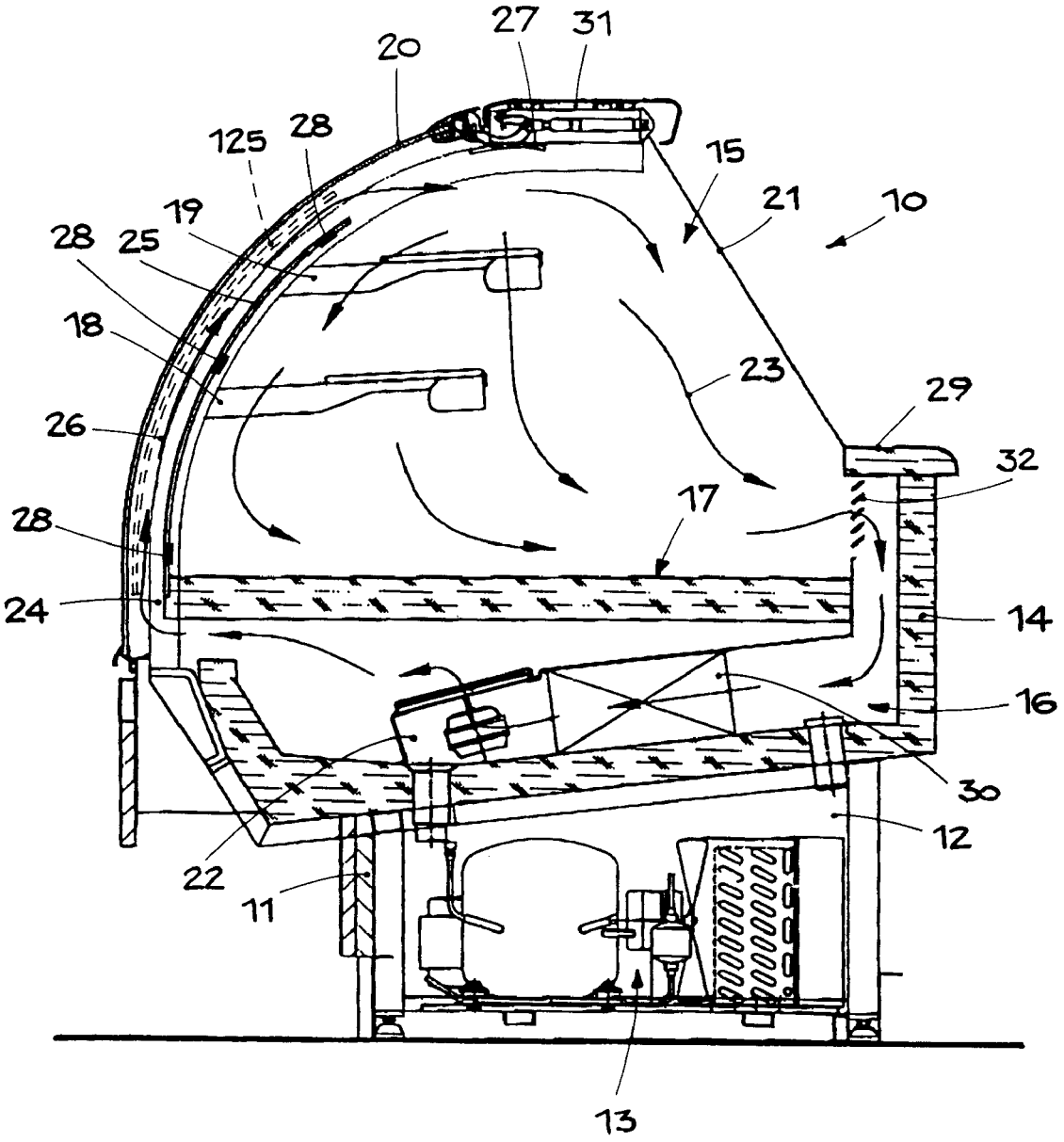
27
31
20
125
28
15
21
10
19
28
25
18
23
29
26
32
17
28
24
14
16
30
12
22
11
13

DEVICE TO DISTRIBUTE AIR IN GLASS-FRONTED CABINETS AND DISPLAY COUNTERS

This application claims benefit of the filing date of prior provisional application No. 60/132,145, filed May 3, 1999.

FIELD OF THE INVENTION

This invention concerns a device to distribute air for glass-fronted cabinets and display counters as set forth in the main claim.

The invention is applied in the field of production of glass-fronted cabinets, display counters or other similar modules used to conserve, display and sell foodstuffs which have to be kept in appropriate climatic conditions of cold or heat.

In the following description we shall describe the example of refrigerated containers, but the invention can be extended to whatever type of glass-fronted cabinet or counter to conserve, display and sell products which have to be kept at a set temperature.

The glass-fronted cabinets or counters are characterised in that they define an at least partly closed volume, climatically conditioned, wherein the products on display are arranged on one or several levels, or are in any case stacked one on top of the other, and wherein the containing volume is delimited at the front part by at least a transparent front-piece which allows customers a complete view of the products.

BACKGROUND OF THE INVENTION

The state of the art includes refrigerated or heated glass-fronted cabinets and counters for display, wherein food products are conserved and displayed for customers interested in buying them.

The glass-fronted cabinets or counters are usually defined by a thermally conditioned compartment, for example refrigerated, wherein the food products to be displayed are arranged on one or more levels, by a technical compartment, usually located below or behind the refrigerated compartment, and by a motor compartment located inside or outside the counter.

The refrigerated compartment is closed at the front by one or more transparent pieces which allow the customers a complete view of the products; at the rear, it is closed by a possible service door, which can be opened and which allows the assistant to access the refrigerated compartment for the usual sales operations.

The technical compartment communicates with the refrigerated compartment, defining together therewith an air-circulation circuit comprising means to deliver cold air and means to recover the air which is then sent to the refrigerator unit arranged inside the technical compartment.

The air-circulation circuit substantially affects the loading zone of the refrigerated compartment, usually limited at the upper part by the service plane located on the side where the sales assistant, or the person in charge of distributing the products, operates.

A problem which businessmen operating in this field particularly complain of is when the products to be displayed and kept under particular conditions of conservation are arranged on several levels inside the refrigerated compartment, for example on shelves one above the other, or simply stacked so as to form a pile to a certain height on the loading surface.

This happens, for example, in counters to display and sell ice cream or frozen foods, pastry or cake products, bottled or canned drinks, or in display cabinets where meat, salami, dairy products or similar products are conserved.

It has been found that the climatic conditions inside the glass-fronted cabinets are extremely variable and that, for this reason, the products in the upper part of the refrigerated volume are not kept at the required conditions of refrigeration.

This obliges the assistants to place, in the upper part, only products which do not need an intense refrigeration.

This situation is aggravated when, in the upper part of the glass-fronted cabinet, there are sources of light which irradiate heat onto the underlying products.

Various solutions have been proposed to overcome this shortcoming, but they have not been satisfactory.

A first solution provides to arrange an evaporator on the ceiling of the refrigerated glass-fronted cabinet.

This solution, however, creates problems with the correct circulation of air, uniformity of temperature, the formation of ice visible in the upper part of the glass-fronted cabinet, and of water dripping onto the products.

Another solution provides to remove the refrigerated air by means of pipes arranged on the lateral uprights of the glass-fronted cabinet, which may even be activated on command, and to send it laterally, by means of appropriately directed outlets, towards the sides of the shelves on which the products to be refrigerated are arranged.

This solution has the main problem that there is a lack of uniformity in the refrigeration between the lateral zones of the shelves, where the refrigeration is very intense, and the central zone of the shelves and in general of the whole central part of the glass-fronted cabinet.

The products positioned at the sides also create a barrier effect on the correct circulation of the refrigerated air. Moreover, if the shelf is curved, the products are only partly affected by the flow of refrigerated air.

Furthermore, this solution creates the problem that the cooling efficiency of the lower part of the glass-fronted cabinet is reduced when the pipes to remove air are activated.

Finally, there is the aesthetically displeasing effect that the pipes are in view, apart from the further technological and operational complexity to ensure a correct functioning.

Obviously, all this equally applies in the case of a compartment which is heated to conserve, display and sell foodstuffs which have to be kept at a certain temperature.

Another solution is proposed in DE-A-37 04 245, which provides a channel on one side of the refrigerated container suitable to convey cold air into the upper part of the refrigerated compartment, and a channel on the opposite side suitable to recover the air and to convey it towards the technical compartment beneath the refrigerated compartment.

This solution does not solve the problems of a uniform refrigeration, especially in the case of containers which are developed particularly lengthwise, creating colder zones on one side and warmer zones on the other side.

Moreover, it does not solve the problem of the barrier effect created by those products which are located higher in the refrigerated compartment, nor the problem of the possible presence of curved shelves.

DE-A-31 37 961 also proposes a solution to convey refrigerated air into the upper part of a refrigerated container which also functions as a food-warmer.

This solution refers to a container of the cupboard type, not to a display container of the type in question; this solution provides that, in cooperation with the rear wall of the cupboard, there is a further wall able to create a channel to convey air towards the upper part of the container.

DE'961 therefore does not propose any solution for the uniform cooling of products facing towards the customer's side, arranged in the upper part of a refrigerated compartment for a display container with a transparent front-piece.

The present Applicant has devised and embodied this invention to overcome the shortcomings of the state of the art, and to obtain further advantages as will be explained hereafter.

SUMMARY OF THE INVENTION

The purpose of the invention is to achieve glass-fronted cabinets and counters to display and sell foodstuffs, refrigerated or heated, which will ensure uniformity of the climatic conditions throughout the volume of the compartment containing the products, without substantially altering the structure and conformation of traditional glass-fronted cabinets and counters.

Another purpose is to obtain this uniformity of temperature by using means which do not create any kind of constraint of an aesthetic type, and guarantee the correct conditions are maintained so that the products inside the containing compartment can be seen.

A further purpose is to obtain desired and uniform refrigeration conditions irrespective of the length of the refrigerated container and irrespective of the quantity and arrangement of the products arranged on the shelf or shelves to be refrigerated.

A further advantage is that it minimises the technological and operational complexity of the refrigeration or heating unit.

According to the invention, the refrigerated glass-fronted cabinet or counter to which the following description refers comprises a substantially conventional structure, consisting of a refrigerated compartment to conserve, display and sell foodstuffs on one or more levels, a technical compartment and possibly an inner motor compartment.

The refrigerated compartment is defined at the front part by a first or outer transparent element, for example a glass pane or a series of panes, arranged on the customer's side and normally closed in the usual operating conditions of the glass-fronted cabinet, and at the rear by an optional closing element arranged on the assistant's side and which can be opened to allow access to the foodstuffs contained therein.

According to a variant, at least the rear closing element arranged on the assistant's side is associated with automatic drive means which cause the glass to open/close according to whether or not the assistant is near the glass.

According to the invention, inside the refrigerated compartment and in co-operation with the first transparent element located on the customer's side there is at least another transparent conveyor element defining at least a transit and guide channel for the refrigerated air.

The transparent conveyor element is suitable to convey and send the air delivered by the delivery means, arranged in the technical compartment of the glass-fronted cabinet, to the upper part of the refrigerated volume of the said glass-fronted cabinet.

The conveyor element extends substantially along the whole length of the glass-fronted cabinet, so as to ensure the refrigerated air is distributed over the whole front thereof, in a completely uniform manner irrespective of the length of the cabinet and irrespective of the load and the arrangement of the products on the refrigerated shelves.

With this solution, the air collected by the delivery means is conveyed upwards and made to exit in the upper or in any case the intermediate part of the glass-fronted cabinet and then directed downwards, where it is distributed uniformly over the whole volume of the refrigerated compartment.

This solution therefore allows to extend the loading zone of the food products inside the refrigerated compartment, overcoming the limitation of traditional glass-fronted cabinets or counters which restrict the loading zone only to the part below the service plane.

Hence the invention allows to guarantee the required conditions of refrigeration even on products kept at a higher level or on levels higher than the service plane or work plane, for example arranged on shelves above the loading surface.

The air is distributed onto the products frontally, from above and in a uniform manner along the whole cabinet; this ensures refrigeration conditions which are constant for all the products aligned on the display shelves.

Moreover, as it travels upwards, the cold air does not meet any sudden element to deflect it, or any significant variation in the section of flow which might cause both a reduction in its cooling power and also high losses of load.

At the same time, since it is transparent, the conveyor element does not create any impediment to the visibility of the products on display, since it is substantially invisible from outside.

Moreover, this solution does not create any complications from the technological point of view either, since the system to deliver, process and recover the air is in no way influenced or modified by the presence of the conveyor element.

A further advantage of the invention is that it does not create any risk of condensation dripping onto the products, since any possible condensation can be formed only on the side of the conveyor element facing towards the transparent front piece.

Another advantage is that the conveyor element allows easy cleaning and maintenance.

According to a variant, in co-operation with the outlet of the conveyor element there is a deflector element suitable to direct the refrigerated air downwards, in such a way as to guarantee a more uniform distribution over the whole volume of the refrigerated compartment.

According to a further variant, the conveyor element has slits for the passage of air, arranged in co-operation with the loading surface and/or with optional shelves at the various heights of the glass-fronted cabinet.

The slits may or may not cooperate with deflector and guide elements to direct the air more efficiently towards the products to be refrigerated.

According to further variants, the conveyor element can be defined by two or more transparent elements arranged one in front of the other in co-operation with the glass on the customer's side, to ensure a better heat insulation with respect to the outside environment.

According to another variant, the transparent air-conveyor element can be replaced with an identical element of a different height, so that it is possible to vary the outlet level of the refrigerated air.

According to a further variant, the transparent air-conveyor element can slide upwards so as to define at will the position of the outlet of the refrigerated air on the height of the glass-fronted cabinet.

BRIEF DESCRIPTION OF THE DRAWING

The attached FIGURE is given as a non-restrictive example and shows a preferential embodiment of the invention.

BRIEF DESCRIPTION OF THE PREFERRED EMBODIMENT

The attached FIGURE shows a possible example of a refrigerated glass-fronted cabinet of the type typically used to display and sell pastry products or cakes and similar.

It is obvious that this example must not be considered restrictive and the invention can be applied to any kind of glass-fronted cabinet, counter or other type of container, refrigerated or heated or in any other way climatically conditioned, wherein it is necessary to make the distribution of air uniform over the whole inner volume where the products are conserved, displayed and sold.

In this case the glass-fronted cabinet 10 comprises a base 11 defining a motor compartment 12 which houses the technological equipment needed for the functioning of the glass-fronted cabinet 10, indicated in their entirety by the reference number 13.

The motor compartment 12, which in this case is inside the glass-fronted cabinet 10, can also be outside the glass-fronted cabinet 10, or can be removed therefrom.

Above the base 11 there is a tank 14 which supports the loading surface 17 and the service plane or work plane 29 located on the assistant's side.

The loading surface 17, together with a front glass 20 located on the customer's side and a rear glass 21 located on the assistant's side, defines a refrigerated compartment 15 which is substantially closed.

The front glass 20 extends for a substantial part above said compartment 15 and terminates at the upper part in an auxiliary plane 31.

The word glass in 20 and 21 shall also include other types of elements, transparent and non-transparent, made of materials other than glass; the rear element 21 may even not be included.

Between the bottom of the tank 14 and the loading surface 17 a technical compartment 16 is defined, one zone of which houses the ventilation unit 22, which causes the refrigerated air to circulate inside the glass-fronted cabinet 10, and the refrigerated unit 30.

The air introduced into circulation by the ventilation unit 22 passes into the refrigerated compartment 15 and is recovered, in this case, through a recovery space 32 located between the service plane 29 and the loading plane 17.

Inside the refrigerated compartment 15, in the case shown here, there are two shelves 18 and 19, arranged one above the other on different levels to contain the food products to be displayed.

The front glass 20 is normally closed and is only opened to allow cleaning operations and/or the loading of more food products.

The rear glass 21 can be opened to allow the assistant to remove and display the food products inside the compartment 15.

According to the invention, the rear glass 21 can be associated with automated opening/closing means, which are not shown here, which make operations easier and more convenient for the assistant.

According to a variant which is not shown here, the opening/closing means are governed by means to detect the absence/presence of the assistant, and automatically cause the glass 21 to close when the assistant goes away from the glass 10, and cause it to open when the assistant comes near again. With this solution the inner volume of the refrigerated compartment 15 stays open only for the time needed by the assistant to carry out the required operations, and the thermodynamic and hygienic conditions of the refrigerated compartment are, in this way, preserved.

The ventilation unit 22 determines a forced circulation of the refrigerated air, indicated by the arrows 23, from the front side to the rear side of the glass-fronted cabinet 10, passing through an interspace 24 between the front edge of the loading surface 17 and the front glass 20.

According to the invention, in an inner position with respect to the front glass 20 there is a conveyor element 25 suitable to define a channel 26 through which the air, collected from the technical compartment 16, is sent towards the upper part of the refrigerated volume of the glass-fronted cabinet 10.

The cold air is sent along the whole front of the cabinet 10 without creating sudden changes of direction or significant reductions in the section of flow in transit.

The conveyor element 25, which extends advantageously for the whole length of the cabinet 10, is made of transparent material and therefore does not impede the view of the inside of the refrigerated compartment 15 in any way, since it is substantially invisible from outside; moreover, the element 25 has the same shape, in this case curved, as the front glass 20.

The conveyor element 25 occupies a part of the height of the front glass 20 and can end in correspondence with the upper part of the compartment 15 or at any desired intermediate part thereof.

By means of the channel 26, and without modifying in any way either the structure and the functional components of the glass-fronted cabinet 10, or the methods and operations of the units which generate the cold, the refrigerated air is transported towards the upper part of the glass-fronted cabinet and made to exit at a desired height so as to be distributed in a uniform manner over the whole inner volume of the refrigerated compartment 15.

To be more exact, the refrigerated air affects the products arranged on the shelves 18 and 19 frontally, from above and in the desired manner, and they can therefore be subjected to refrigeration with the intensity required by the type of product.

According to a variant, at the outlet of the conveyor element 25 there is a deflector element 27 suitable to direct the refrigerated air emerging from the channel 26 towards the inside of the refrigerated compartment 15.

In the embodiment shown here, along the conveyor element 25 there are slits 28 suitable to direct the refrigerated air in correspondence with the food products arranged on the loading surface 17 and/or on the shelves 18 and 19.

The slits 28 may or may not be associated with deflector and guide edges able to facilitate the frontal delivery of the flow of refrigerated air towards the products on display.

According to another variant, the conveyor element 25 can be replaced according to the desired outlet position of the refrigerated air.

According to a further variant which is not shown here, the conveyor element 25 can slide downwards so that it is possible to adjust the upper outlet level of the refrigerated air.

According to another variant, the channel 26 through which the air passes is defined between a first conveyor element 25 and a second conveyor element 125, shown with a line of dashes, in order to improve the heat insulation of the refrigerated compartment 15 with respect to the outside environment.

There may also be three or more conveyor elements, in the case of very intense refrigeration, to define a better heat insulation with respect to the outside environment.

According to a further variant, the conveyor element 25 is made in a single piece with the front glass 20 so as to achieve a multi-glass structure defining the air transit channel 26.

What is claimed is:

1. Device to distribute air for glass-fronted cabinets, counters, or in general containers which are refrigerated, heated or otherwise climatically conditioned, said containers (10) comprising at least a compartment (15) defining a volume containing the foodstuffs to be conserved, sold and/or displayed, said compartment (15) including a loading plane (17) cooperating with a service plane (29) located above, an air recovery space (32) being included between loading plane (17) and service plane (29), said containers (10) also comprising a technical compartment (16) inside which at least the ventilation unit (22) and the optional thermal conditioning unit (30) are housed, said containers (10) comprising at least a transparent front element (20) facing the customer's side, extending for a substantial part above said compartment (15) and cooperating with said loading surface (17), said transparent front element (20) including at the upper part an auxiliary plane (31), the device being characterised in that it comprises a conveyor element (25) transparent and substantially invisible arranged inside the compartment (15) and adjacent said transparent front piece and being suitable to define, together with said transparent front-piece (20), an air-conveyor channel (26) which affects at least up through an intermediate part of said transparent front element (20).

2. Device as in claim 1, characterised in that said conveyor channel (26) terminates in the high part of the compartment (15).

3. Device as in claim 1, characterised in that at least part of said channel (26) terminates in the intermediate part of the compartment (15).

4. Device as in claim 1, characterised in that said conveyor element (25) develops at least for a substantial part of the length of the refrigerated container.

5. Device as in claim 1, characterised in that said conveyor element (25) is arranged immediately behind the front transparent element (20).

6. Device as in claim 1, characterised in that there is a deflector element (27) in co-operation with the upper terminal part of said conveyor element (25).

7. Device as in claim 1, characterised in that said conveyor element (25) has slits (28) for the passage of air, positioned in co-operation with elements (17, 18, 19) to support and display food products.

8. Device as in claim 1, characterised in that the conveyor element (25) cooperates with at least a second conveyor element (125) arranged in an intermediate position between the transparent front element (20) and said conveyor element (25).

9. Device as in claim 1, characterised in that the conveyor element (25) is replaceable according to the desired outlet position of the refrigerated air.

10. Device as in claim 1, characterised in that the conveyor element (25) is movable to define variable levels for the air to exit on the height of the compartment (15).

11. Device as in claim 1, characterised in that the conveyor element (25) is solid with the transparent front element (20) facing the customer's side so as to define a multi-glass structure.

12. Device as in claim 1, characterised in that it cooperates with a motor compartment (12), outside or inside the container (10), inside which the technological equipment (13) for the functioning of the glass-fronted cabinet (10) is housed.

13. A climatically conditioned display cabinet for foodstuffs, comprising:

a display compartment for displaying the foodstuffs therein, the display compartment having a loading plane and a transparent front element facing a customer side of the display compartment;

a technical compartment containing a ventilation unit for circulating climatically controlled air through the display compartment and the technical compartment;

an air recovery space for connecting one end of the technical compartment to the display compartment for returning air circulated through the display compartment into the technical compartment;

a conveyor element made of transparent material provided inside the display compartment adjacent to and spaced from at least a part of a height of the transparent front element and defining an air conveyor channel between the conveyor element and the transparent front element, the air conveyor channel being connected at a lower end to the technical compartment and opening into an intermediate or upper part of the display compartment at an upper end for passing the climatically controlled air from the technical compartment to the display compartment.

14. The climatically conditioned display cabinet according to claim 13, further comprising a service plane provided on an assistant side of the display compartment opposite the customer side.

15. The climatically conditioned display cabinet according to claim 14, wherein the service plane is provided at a level above the loading plane, and wherein the air recovery space is provided between the service plane and the loading plane.

16. The climatically conditioned display cabinet according to claim 13, further comprising at least one shelf for displaying foodstuffs thereon provided in the display compartment above the loading plane.

17. The climatically conditioned display cabinet according to claim 14, further comprising a rear closure element movable between an open and closed position for opening and closing the display compartment on the assistant side.

18. The climatically conditioned display cabinet according to claim 13, wherein the upper end of the air conveyor channel terminates at the intermediate part of the display compartment.

19. The climatically conditioned display cabinet according to claim 13, wherein the upper end of the conveyor channel terminates at the upper part of the display compartment.

20. The climatically conditioned display cabinet according to claim 13, wherein the transparent front element has a curved shape and wherein the conveyor element has the same curved shape as the transparent front element.

21. The climatically conditioned display cabinet according to claim 13, wherein the upper end of the conveyor channel terminates above the at least one shelf.

* * * * *